United States Patent [19]

Horn

[11] Patent Number: 4,997,199

[45] Date of Patent: Mar. 5, 1991

[54] FOOT PLATE FOR A SKI BINDING

[75] Inventor: Hans Horn, Bern, Switzerland

[73] Assignee: Skis Rossignol S.A., Switzerland

[21] Appl. No.: 478,618

[22] Filed: Feb. 12, 1990

[30] Foreign Application Priority Data

Feb. 27, 1989 [FR] France ..... 89 02517

[51] Int. Cl.[5] ..... A63C 9/08

[52] U.S. Cl. ..... 280/618; 280/633

[58] Field of Search ..... 280/607, 617, 618, 633, 280/634

[56] References Cited

U.S. PATENT DOCUMENTS

| | | | |
|---|---|---|---|
| 4,188,045 | 2/1980 | Marker | 280/618 X |
| 4,336,955 | 6/1982 | Schmidt | 280/618 |
| 4,600,213 | 7/1986 | Sedlmair et al. | 280/618 |

*Primary Examiner*—Charles A. Marmor
*Assistant Examiner*—Michael Mar
*Attorney, Agent, or Firm*—Kane, Dalsimer, Sullivan, Kurucz, Levy, Eisele and Richard

[57] ABSTRACT

Foot plate for a ski binding, mounted pivotably on the ski about a pivot (3) and equipped with a guide member for retaining the foot plate against the ski. These guide members comprise a metal plate (20) mounted slidably beneath a piece fastened to the ski, such as a yoke (21). The opposite transverse edges (20*a*, 10*b*) of this plate are engaged and slide in grooves in the foot plate (1). The tensile force on the yoke is independent of the longitudinal position of the plate. Such a mounting is particularly advantageous for a foot plate in two parts (4, 7) which can be displaced relative to each other, one carrying a fixed grip (5) for holding in place the front part of the boot, and the other a heel unit (8).

5 Claims, 3 Drawing Sheets

P1=P2+P3=P4

M1<M2
M3<M4
P2<P3

FOOT PLATE FOR A SKI BINDING

FIELD OF THE INVENTION

The present invention relates to a foot plate for a ski binding, mounted pivotably on the ski about a vertical pivot and equipped with guide means for retaining the plate against the ski, whilst at the same time allowing it to rotate.

PRIOR ART

Foot plates are known for plate safety bindings, consisting of two parts which can be displaced relative to each other so as to enable the distance to be altered between the means for holding in place the front end of the boot, which are carried by one of the parts, and the means for holding in place the heel, which are carried by the other part, in order to adapt the binding to the length of the boot. When the foot plate is extended or shortened, one of the parts of this plate, generally the front part, must be displaced relative to these guide means. These front guide means consist of a horizontal bearing surface fastened to the ski and beneath which is engaged a corresponding horizontal bearing surface of the plate. It is known that the means for holding the boot in place, both at the rear and the front, are subjected to substantial vertical forces which are translated as substantial moments on the abovementioned bearing surfaces, which moments are translated as substantial stresses on the bases of these bearing surfaces and on the fastening means for the bearing surface fastened to the ski. When the bearing surfaces cover each other completely, these stresses do not present any danger. However, when the bearing surfaces are in contact only by their end, the moments become very substantial and the corresponding forces become dangerous, both for the plate and for the bearing surface fastened to the ski, which may be torn away from the ski.

Furthermore, when the foot plate is a single piece and where the pivot of the plate permits a bending of the ski in the region of the binding, the distance between its guide points may vary by in the order of 5 mm.

The object of the invention is to suppress the dangerous stresses by an appropriate embodiment of the guide means.

SUMMARY OF THE INVENTION

The ski binding according to the invention has guide means which consist of a plate mounted slidably along the axis of the ski, beneath a piece fastened to the ski, and the opposite edges of which, transverse to the ski, are engaged and slide in grooves in the plate.

The vertical forces on the holding means are thus distributed over both sides of the sliding plate. There is no longer any moment on the foot plate and on the piece fastened to the ski and the tensile force exerted on this piece is always equal to the tensile force exerted on the holding means. The sliding plate easily sustains all the bending forces.

The construction according to the invention not only enables the dangerous stresses to be suppressed, but also enables the length-adjustment range of a 2-part plate binding to be increased enormously. Consequently, when a different person uses the ski, it is no longer necessary to displace the guide means fastened to the ski, in other words to make new holes in the ski.

The construction according to the invention is not only advantageous for a foot-plate binding with a fixed or adjustable length, but also for a binding of a new telescopic-plate type which will be described later.

BRIEF DESCRIPTION OF THE DRAWINGS

The attached drawing shows, by way of example, an embodiment of the invention.

DESCRIPTION OF THE PREFERRED EMBODIMENT

Figure 1:
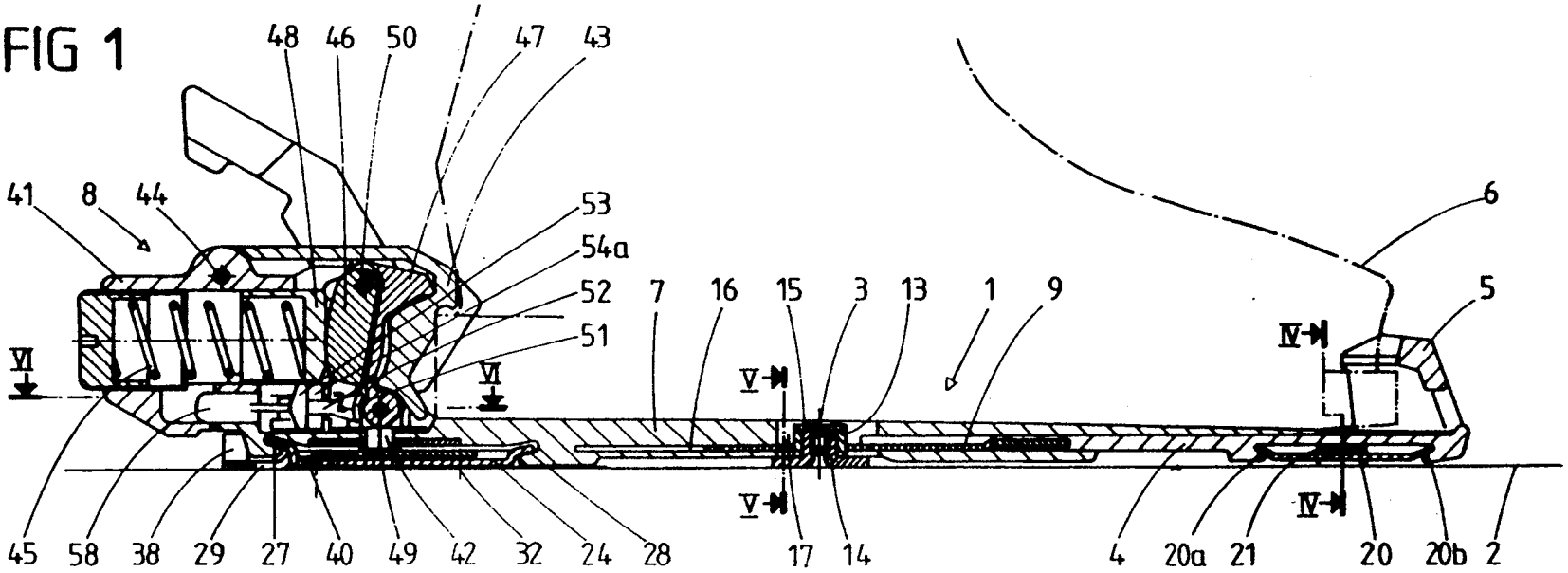
FIG. 1 is a view in axial cross-section along I—I in FIG. 2 of a plate binding fitted with a heel unit.
Figure 2:
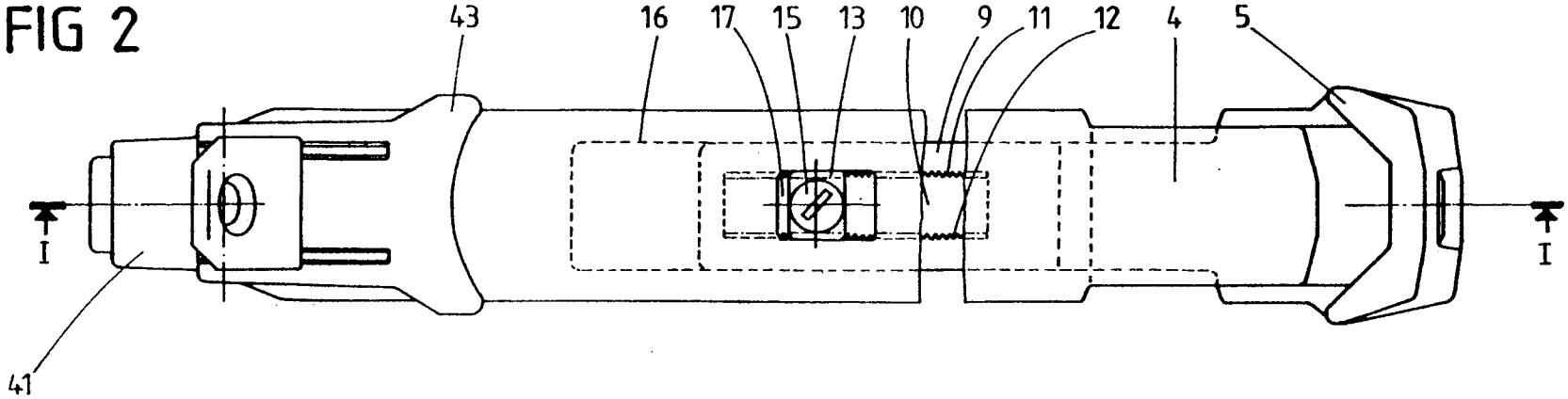
FIG. 2 is a plan view from above.

The binding shown comprises a plate 1 mounted pivotably on a ski 2 about a pivot 3. The plate 1 comprises a fixed part 4 made from a single piece with a fixed grip 5 at its end for holding in place the front part of a boot 6, and a movable part 7 carrying, at the rear, a heel unit 8 for holding in place the heel of the boot 6.

The fixed part 4 of the plate is here made from a light metal alloy and it is fitted with a steel plate 9 having a longitudinal rectangular cutout 10, the long sides of which are provided with a toothing 11 and 12. This toothing meshes with the teeth of a guide block 13 mounted pivotably on the cylindrical part of a cylindrical support 14 fastened to the ski 2. The guide block 13 is held in place on the support 14 by a screw 15. The toothed guide block 13 and the toothed cutout 10 enable the length between the pivot 3 and the front grip 5 to be adjusted, in other words the length of the binding to be adjusted depending on the length of the boot.

Figure 3:
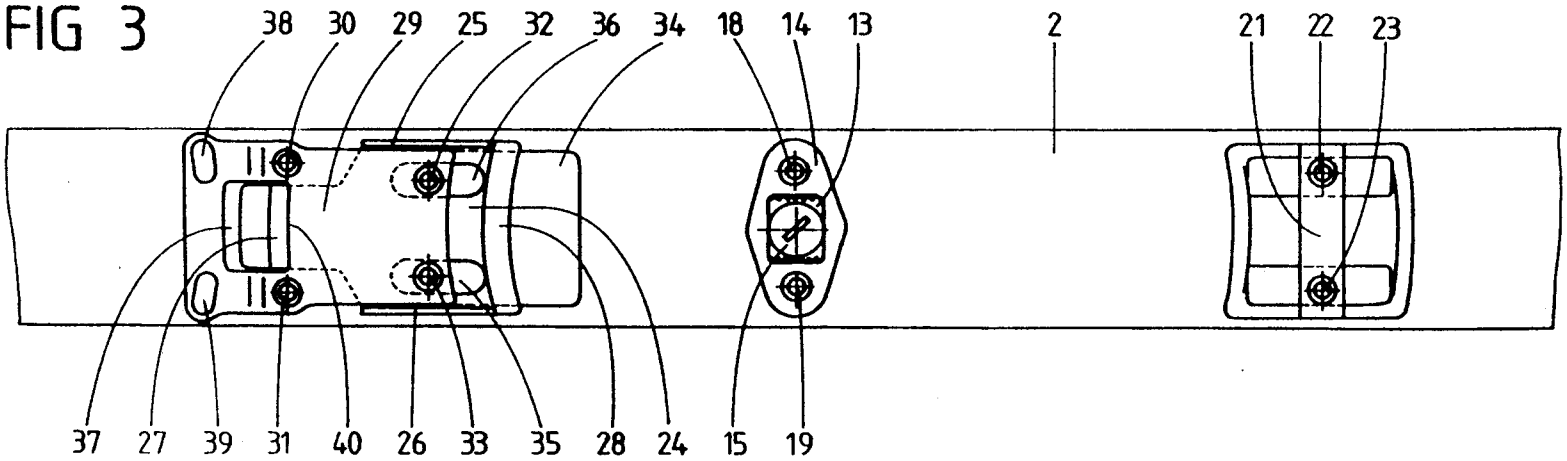
FIG. 3 is a plan view of the ski without the plate.

The movable part 7 of the plate extends on and beneath the fixed plate 4. Its upper part tapers to near the grip 5 such that the boot 6 rests only on this part 7 of the plate. The part 7 of the plate extending beneath the part 4 serves for the vertical retention of this part 7 which has a horizontal slot 16 into which enters the toothed plate 9. The part 7 furthermore has a cutout 17 which enables, on the one hand, the longitudinal displacement of the plate relative to the pivot 3 and, on the other hand, access to the screw 15 in order to adjust the length of the binding. In FIG. 3, it can be seen that the support 14 is fastened to the ski by means of two screws 18 and 19.

Figure 4:
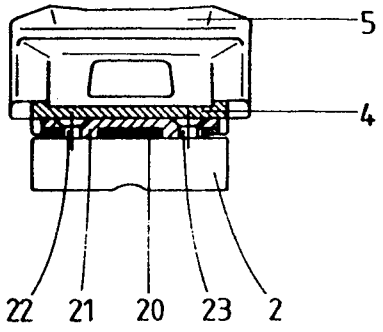
FIG. 4 is a cross-sectional view along IV—IV in FIG. 1.

At the front, the fixed part 4 of the plate is retained vertically by a metal plate 20 with a generally rectangular shape and the edges 20*a* and 20*b* of which, transverse to the ski, are slightly raised obliquely and are in the shape of arcs of a circle centered on the axis of the pivot 3. These raised edges 20*a* and 20*b* are engaged in recesses of the part 4 of the plate and can slide in these recesses. The plate 20 is itself retained by a yoke 21 fastened to the ski by two screws 22 and 23 (FIGS. 3 and 4).

At the rear, the movable part 7 of the plate is also retained vertically and guided by a metal plate 24 having two vertical edges, parallel to the axis of the ski, 25 and 26 and two sides, transverse to the ski, 27 and 28, the edges of which are raised in arcs of a circle centered on the axis of the pivot 3 and engaged in recesses of the part 7 in which they can slide when the plate pivots. The plates 24 is retained vertically by a plate 29 having two levels, one of which extends over the plate 24. This plate 29 is fastened to the ski by means of four screws 30, 31, 32 and 33 traversing spacers holding the plate 29 at a distance from the ski. The screws 32 and 33 and their spacers traverse the plate 24 through two oblong cutouts 35 and 36 so as to enable the plate 24 to be displaced axially. A metal plate with a small coefficient of friction 34 is arranged between the plate 24 and the ski 2 in order to facilitate the displacement of the plate 24. The plate 29 has a cutout 37 through which passes the rear raised edge 27 of the plate 24. At the rear, the plate 29 carries two stops 38 and 39 arranged on either side of the longitudinal axis of the binding and symmetrically about this axis. The front edge 40 of the cutout 37 serves as a stop for the plate 24.

Figure 6:
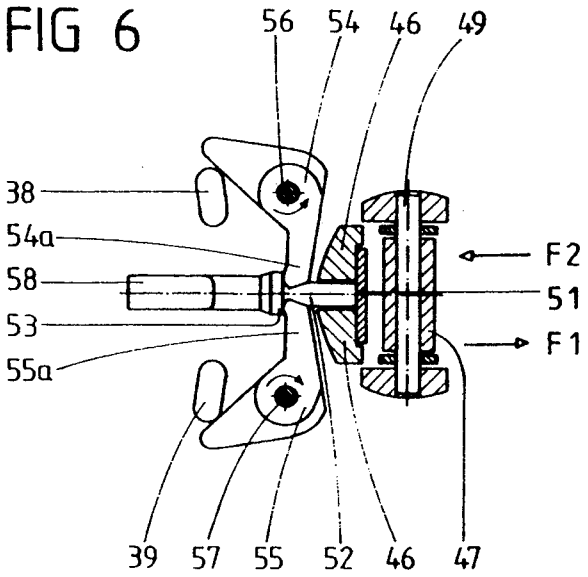
FIG. 6 is a partial and enlarged view of a cross-section along VI—VI in FIG. 1 illustrating the operation of the binding in a backward fall.
Figure 5:
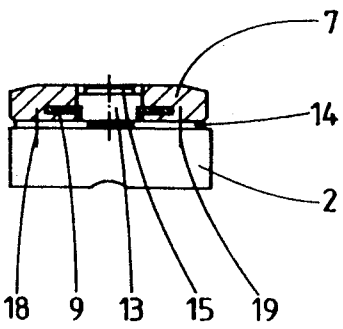
FIG. 5 is a cross-sectional view along V—V in FIG. 1.

The heel unit 8 comprises a body 41 mounted pivotably on the movable part 7 of the plate by means of a vertical pivot 42. This heel unit comprises a grip 43 articulated on the body 41 about a pin 44 in order to hold in place the heel of the boot. This grip 43 is held in place elastically by means of a spring 45 acting on the grip 43 via a two-lever 46/47 system and via a piston 48. The lever 47 is articulated about a transverse horizontal pin 49 situated just above the pivot 42. The lever 46 is itself articulated on the lever 47 at its upper part about a transverse pin 50. The split lower end of the lever 46 bears against the head 51 of a rod 52 directed in the axis of the binding and provided with a bearing surface 53 against which bear the ends 54*a* and 55*a* of two angled levers 54 and 55 mounted on a vertical pin 56 and 57 respectively on the movable part 7 of the plate (FIG. 6). The rod 52 ends in a lock 58 intended to lock the heel unit in rotation on the plate. The spring 45, via the lever 46, consequently pushes the head 51 in the direction of the arrow F1, the levers 54 and 55 therefore tending to rotate in the direction indicated by the arrows, pressing against the fixed stops 38 and 39. The reaction of the stops 38 and 39 therefore tends to push the part 7 of the plate forwards, such that the part 27 of the plate 24 abuts against the edge 40.

In the event of a backward fall with backward pressure, a force F2 is exerted on the heel unit 8. This force F2 opposes the force F1 exerted by the spring 45. The movable part 7 of the plate moves back, compressing this spring 45. The boot 6 moves back with the movable part 7 of the plate and is released from the front grip 5 in order to be completely freed from the binding.

The abutting could take place at the center with the rear end of the cutout 17 against the pivot 3.

Figure 7:
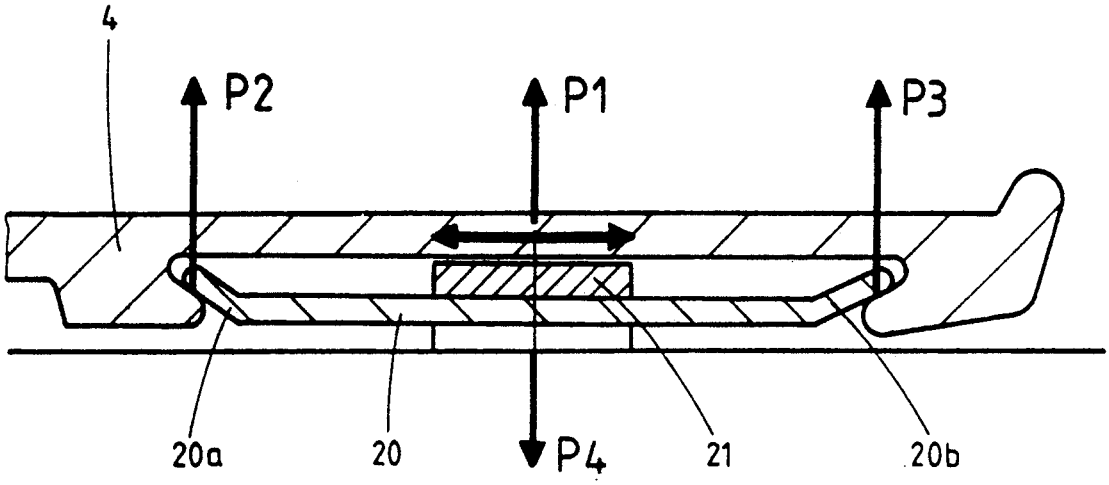
FIG. 7 shows the distribution of the forces in the guide means at the front of the plate.
Figure 8A:
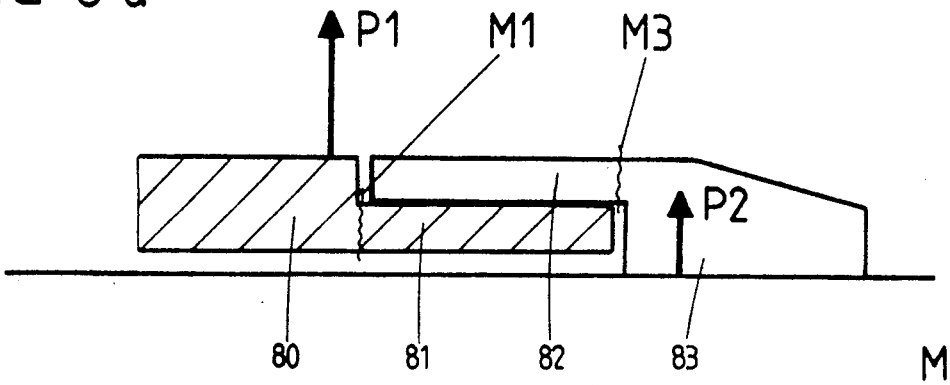
FIG. 8 shows the forces which appear in a binding according to the prior art.
Figure 8B:
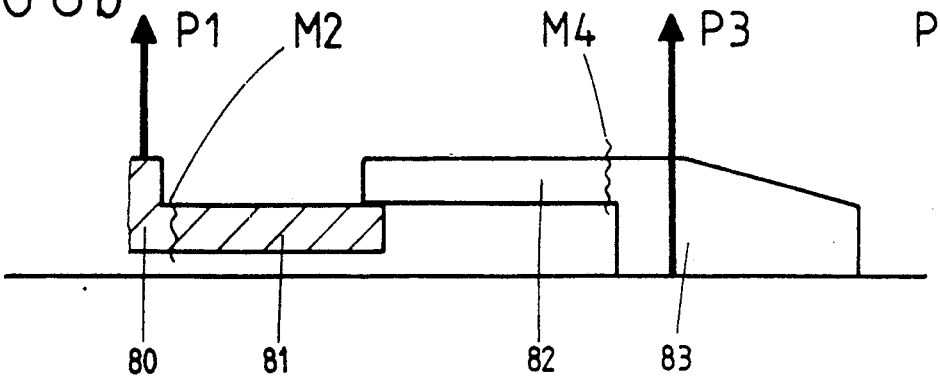

The advantages of the invention will appear clearly upon comparison of FIGS. 7 and 8. FIG. 7 illustrates the forces appearing at the front of the binding which has just been described. A vertical force on the front toe unit 5 is translated as a vertical force P1 on the plate 4. This force P1 is divided into two forces P2 and P3 on the edges 20*a* and 20*b* of the sliding plate 20. There is a force P4 equal to the force P1 on the yoke 21. Then $P1=P2+P3=P4$. These conditions apply whatever the position of the sliding plate 20 relative to the yoke 21. Let us now compare the conditions existing in the prior art. FIG. 8*a* shows a plate 80 engaged by a bearing surface 81 beneath a fixed bearing surface 82 integral with a mounting base 83 fastened to the ski. A vertical force P1 on the plate 80 is translated as a moment M1 at the base of the bearing surface 81 and as a moment M3 at the base of the bearing surface 82, which is itself translated as a tensile force P2 on the fastening screw of the mounting base 83. FIG. 8*b* shows the position of the same elements after the foot plate has been shortened. The bearing surfaces 81 and 82 bear against each other only at their ends. The moments M2 and M4 at the base of these bearing surfaces are greater than the moments M1 and M3 respectively and the tensile force P3 on the fastening screw of the mounting base 83 is much greater than P2.

The same advantages are found at the rear between the fixed retention plate 29 and the movable plate 24 which is displaced each time the skier puts on or takes off the boot and during each release in a backward fall.

Given the division of the force P1 into two forces P2 and P3, the plates 20 and 24 are stressed less and could be made from a material other than steel, for example from a synthetic material.

As distinct from the prior plate bindings, the binding according to the invention has the further advantage of not requiring an accurate adjustment of the distance between the heel unit and the front toe unit since an excessively short distance is automatically compensated for by the backward movement of the movable part 7 of the plate and the compression of the spring 45, as is the case in independent heel unit and front toe unit bindings having no plate. There is therefore an automatic adaptation of the binding to the length of the sole of the boot.

The principle described for the guide means can also be applied to a plate which carries only the front or rear means for holding the boot in place.

I claim:

1. A foot plate assembly for a ski binding comprising: a pivot member fixed to a ski, a foot plate pivotably mounted to said pivot member for rotation about a vertical axis, a first arcuate-shaped transverse groove extending beneath the lower surface of said foot plate, said first groove having longitudinally spaced wall portions extending towards each other forming opposed recesses, a first guide plate having forward and rearward transversely extending edges, and a first fastening member overlying said first guide plate for securing said first guide plate to said ski, said first fastening member permitting said first guide plate to be slidable within a limited range along the longitudinal axis of the ski, wherein said first guide plate is slidably receivable within said first groove with the forward and rearward edges of said first guide plate being received within said opposed recesses.

2. The foot plate assembly as defined in claim 1 including a second arcuate-shaped transverse groove extending beneath the lower surface of said foot plate, said second groove having longitudinally spaced wall portions extending towards each other forming opposed recesses, a second guide plate having forward and rearward transversely extending edges, and a second fastening member overlying said second guide plate for securing said second guide plate to said ski.

3. The foot plate assembly as defined in claim 2 wherein said forward and rearward edges of said first and second guide plates are raised obliquely.

4. The foot plate assembly as defined in claim 3 wherein said second fastening member comprises a yoke.

5. The foot plate assembly as defined in claim 3 wherein said first fastening member comprises a plate fastened to the ski by screws provided with spacers, said screws and spacers extending through longitudinal slots formed in said second guide plate.

* * * * *

UNITED STATES PATENT AND TRADEMARK OFFICE

CERTIFICATE OF CORRECTION

PATENT NO. : 4,997,199

DATED : March 5, 1991

INVENTOR(S) : Hans Horn

It is certified that error appears in the above-identified patent and that said Letters Patent is hereby corrected as shown below:

On the title page, column 1, [73] change "Switzerland" to --France--

Signed and Sealed this

Nineteenth Day of January, 1993

*Attest:*

DOUGLAS B. COMER

*Attesting Officer*

*Acting Commissioner of Patents and Trademarks*